US009236659B2

(12) United States Patent
Vazquez et al.

(10) Patent No.: US 9,236,659 B2
(45) Date of Patent: Jan. 12, 2016

(54) ELECTRONIC DEVICE WITH HYBRID INVERTED-F SLOT ANTENNA

(71) Applicant: Apple Inc., Cupertino, CA (US)

(72) Inventors: Enrique Ayala Vazquez, Watsonville, CA (US); Hongfei Hu, Santa Clara, CA (US); Mattia Pascolini, San Mateo, CA (US); Yuehui Ouyang, Sunnyvale, CA (US); Yijun Zhou, Sunnyvale, CA (US); Matthew A. Mow, Los Altos, CA (US); Robert W. Schlub, Cupertino, CA (US); Erdinc Irci, Sunnyvale, CA (US); Salih Yarga, Sunnyvale, CA (US); Ming-Ju Tsai, Cupertino, CA (US); Liang Han, Sunnyvale, CA (US); Thomas E. Biedka, San Jose, CA (US); Nicholas S. Reimnitz, Campbell, CA (US)

(73) Assignee: Apple Inc., Cupertino, CA (US)

( * ) Notice: Subject to any disclaimer, the term of this patent is extended or adjusted under 35 U.S.C. 154(b) by 222 days.

(21) Appl. No.: 14/096,417

(22) Filed: Dec. 4, 2013

(65) Prior Publication Data

US 2014/0266941 A1 Sep. 18, 2014

(51) Int. Cl.

| | |
|---|---|
| ***H01Q 1/24*** | (2006.01) |
| ***H01Q 13/10*** | (2006.01) |
| ***H01Q 9/14*** | (2006.01) |
| ***H01Q 9/42*** | (2006.01) |
| ***H01Q 5/357*** | (2015.01) |

(52) U.S. Cl.

CPC ..... *H01Q 13/103* (2013.01); *H01Q 1/243* (2013.01); *H01Q 5/357* (2015.01); *H01Q 9/145* (2013.01); *H01Q 9/42* (2013.01)

(58) Field of Classification Search

USPC ..... 343/700 MS, 702, 729, 746, 767

See application file for complete search history.

(56) References Cited

U.S. PATENT DOCUMENTS

| | | | | |
|---|---|---|---|---|
| 7,864,123 | B2 | 1/2011 | Hill et al. | |
| 7,876,274 | B2 | 1/2011 | Hobson et al. | |
| 7,893,883 | B2 * | 2/2011 | Schlub | H01Q 1/243 343/700 MS |

(Continued)

FOREIGN PATENT DOCUMENTS

| | | |
|---|---|---|
| EP | 2538490 | 12/2012 |

OTHER PUBLICATIONS

Bevelacqua et al., U.S. Appl. No. 13/860,396, filed Apr. 10, 2013.

(Continued)

*Primary Examiner* — Tan Ho

(74) *Attorney, Agent, or Firm* — Treyz Law Group, P.C.; G. Victor Treyz; Michael H. Lyons

(57) ABSTRACT

An electronic device may be provided with a housing. The housing may have a periphery that is surrounded by peripheral conductive structures such as a segmented peripheral metal member. A segment of the peripheral metal member may be separated from a ground by a slot. An antenna feed may have a positive antenna terminal coupled to the peripheral metal member and a ground terminal coupled to the ground and may feed both an inverted-F antenna structure that is formed from the peripheral metal member and the ground and a slot antenna structure that is formed from the slot. Control circuitry may tune the antenna by controlling adjustable components that are coupled to the peripheral metal member. The adjustable components may include adjustable inductors and adjustable capacitors.

20 Claims, 11 Drawing Sheets

(56) References Cited

U.S. PATENT DOCUMENTS

| | | | | |
|---|---|---|---|---|
| 8,270,914 | B2 | 9/2012 | Pascolini et al. | |
| 8,325,096 | B2 | 12/2012 | Ayala Vazquez et al. | |
| 8,410,986 | B2 | 4/2013 | Hill et al. | |
| 8,610,629 | B2 | 12/2013 | Pascolini et al. | |
| 2009/0322639 | A1 * | 12/2009 | Lai | H01Q 1/243 343/770 |
| 2011/0241949 | A1 | 10/2011 | Nickel et al. | |
| 2012/0112969 | A1 | 5/2012 | Caballero et al. | |
| 2012/0112970 | A1 | 5/2012 | Caballero et al. | |
| 2012/0299785 | A1 | 11/2012 | Bevelacqua | |
| 2013/0169490 | A1 | 7/2013 | Pascolini et al. | |
| 2013/0201067 | A1 | 8/2013 | Hu et al. | |
| 2013/0203364 | A1 | 8/2013 | Darnell et al. | |
| 2013/0257659 | A1 | 10/2013 | Darnell et al. | |

OTHER PUBLICATIONS

Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Ayala-Vasquez et al., U.S. Appl. No. 13/889,987, filed May 8, 2013.
Bevelacqua et al., U.S. Appl. No. 13/851,471 filed, Mar. 27, 2013.

* cited by examiner

ELECTRONIC DEVICE WITH HYBRID INVERTED-F SLOT ANTENNA

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with a housing. The housing may have a periphery that is surrounded by peripheral conductive structures such as a peripheral metal member. A segment of the peripheral metal member may be separated from a ground by a slot that runs along an inner edge of the peripheral metal member. An antenna feed may have a positive antenna feed terminal coupled to the peripheral metal member and a ground antenna feed terminal coupled to the ground and may feed both an inverted-F antenna structure that is formed from the peripheral metal member and the ground and a slot antenna structure that is formed from the slot.

Control circuitry may tune the antenna by controlling adjustable components that are coupled to the peripheral metal member. The adjustable components may include adjustable inductors and adjustable capacitors. A hybrid antenna may be formed from the inverted-F antenna structure and the slot antenna structure, which are fed using a common antenna feed. The hybrid antenna may be configured to resonant in multiple communications bands. For example, the hybrid antenna may be configured to cover a low band, a middle band, and a high band. The inverted-F antenna may have a resonating element arm with a long branch that generates an antenna resonance in the low band and a short branch that generates an antenna resonance for the middle band. The high band response of the antenna may be supported by the slot and using a harmonic of an inverted-F antenna resonance.

The adjustable components may bridge the slot. The control circuitry may tune the low band using an inductor that bridges the slot, may tune the middle band using an inductor that bridges the slot, or may otherwise use an adjustable inductor or multiple adjustable inductors to tune antenna performance. High band antenna adjustments may be performed using an adjustable capacitor that bridges the slot or other adjustable components.

DETAILED DESCRIPTION

Figure 1:
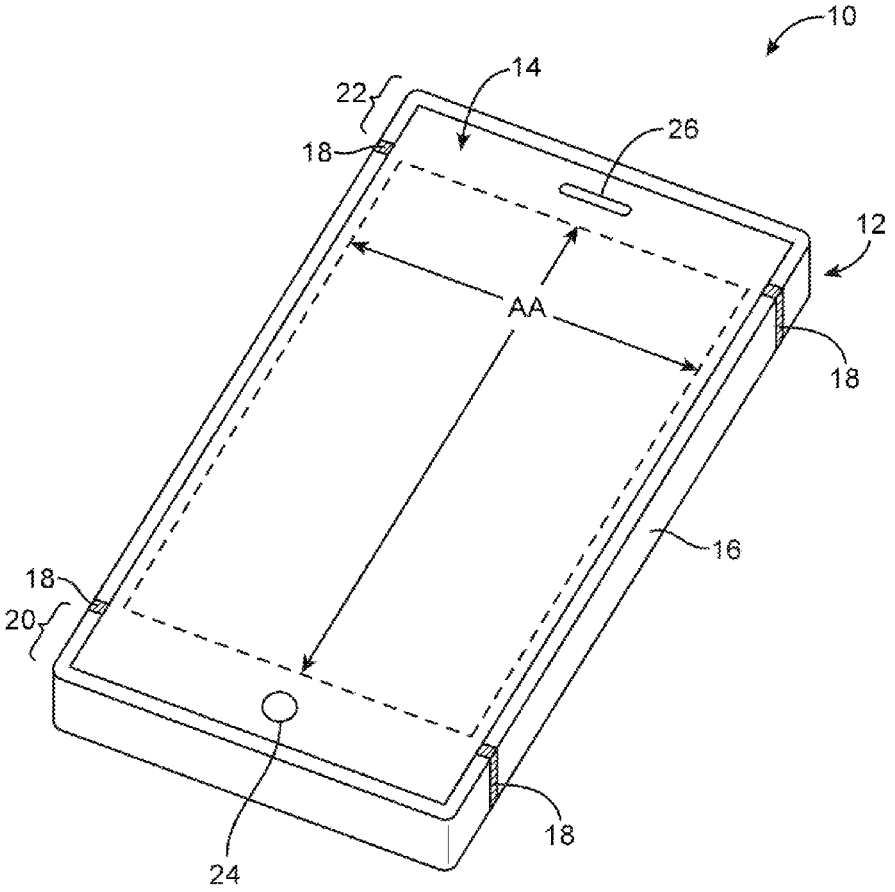
FIG. 1 is a perspective view of an illustrative electronic device with wireless circuitry in accordance with an embodiment.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps may be formed in the peripheral conductive member that divide the peripheral conductive member into segments. One or more of the segments may be used in forming one or more antennas for electronic device 10.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using a peripheral housing member have a rectangular ring shape with four corresponding edges (as an example). Peripheral structures 16 or part of peripheral structures 16 may serve as a bezel for display 14 (e.g. a cosmetic trim that surrounds all four sides of display 14 and/or helps hold display 14 to device 10). Peripheral structures 16 may also, if desired, form sidewall structures for device 10 (e.g. by forming a metal band with vertical sidewalls, etc.).

Peripheral housing structures 16 may be fomled of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g. in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g. when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains circuitry and other structures for displaying images).

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, extensions of the ground plane under active area AA of display 14 and/or other metal structures in device 10 may have portions that extend into parts of the dielectric-filled openings in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
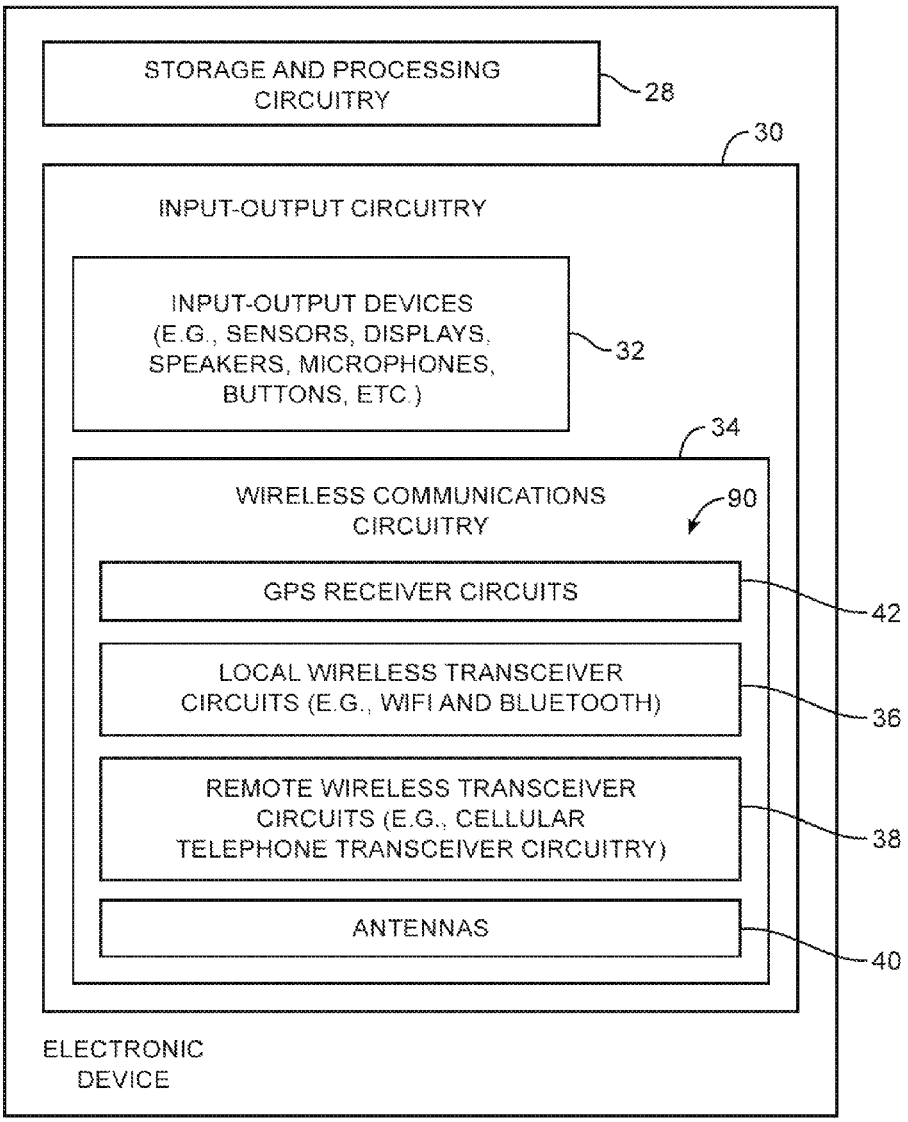
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g. flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications hands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
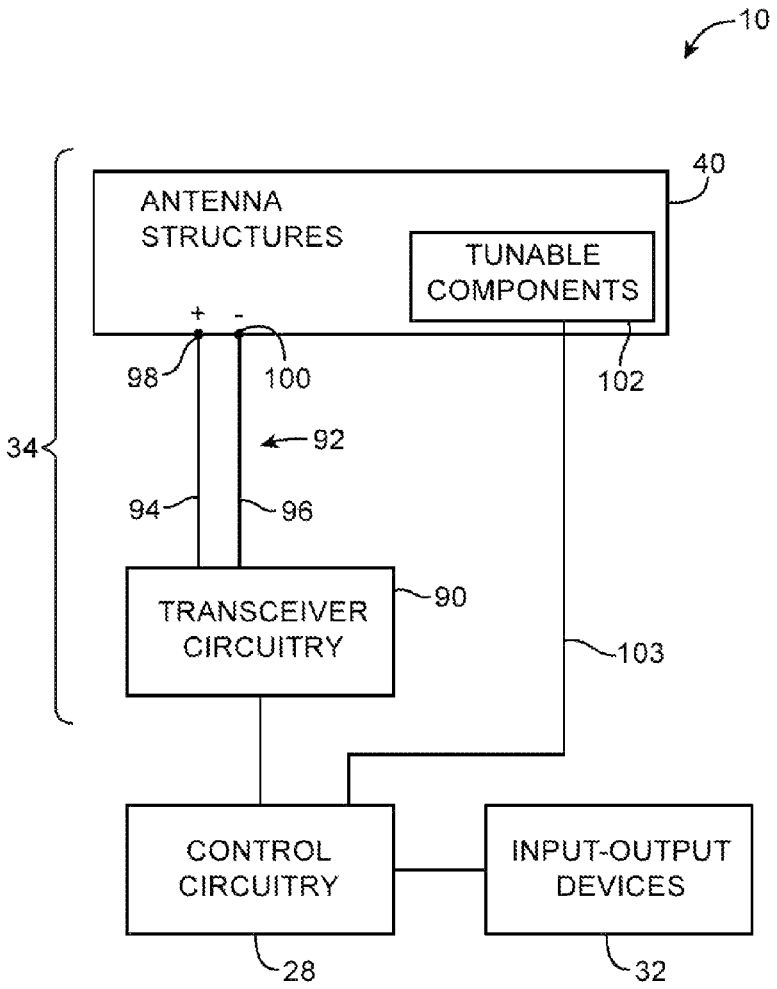
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 26 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 103 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g. surface mount technology components) or may be formed from housing structures, printed circuit board structures, traces on plastic supports, etc. Components such as these may also be used in forming filter circuitry in antenna structures 40.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 3 is merely illustrative.

Figure 4:
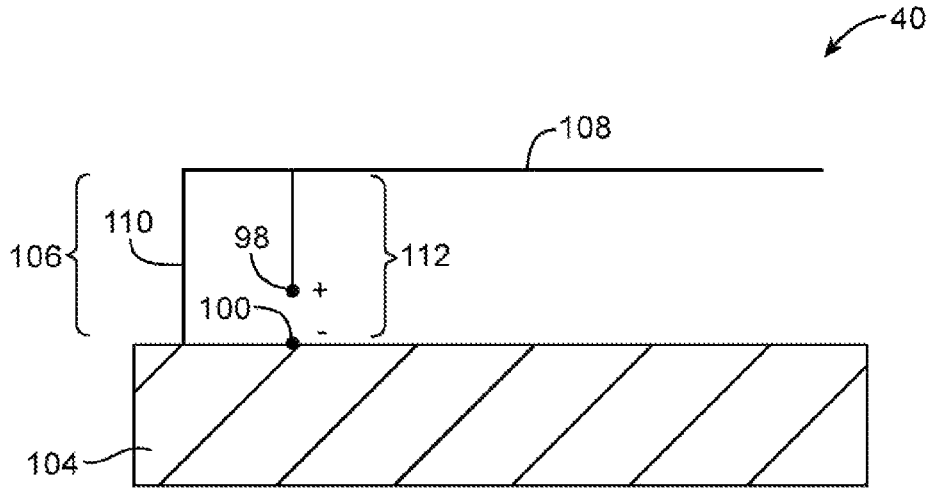
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.).

Figure 5:
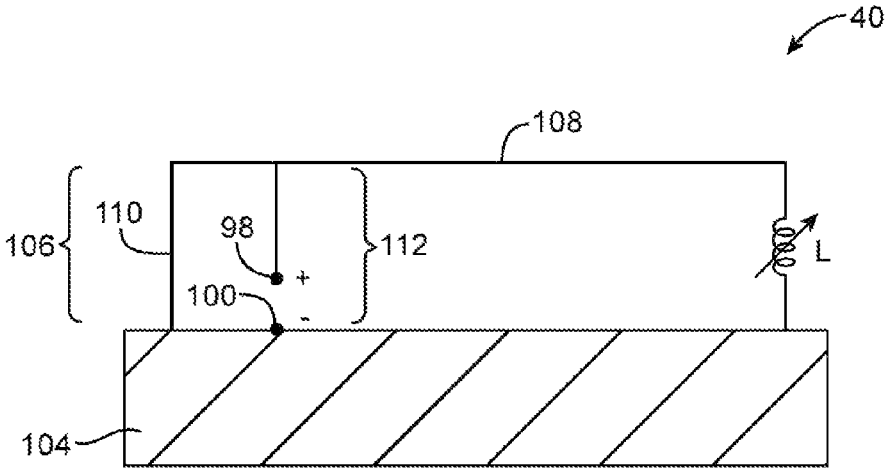
FIG. 5 is a schematic diagram of an illustrative inverted-F antenna with an inductor to tune the antenna to cover desired operating frequencies in accordance with an embodiment.

FIG. 5 is a diagram of an illustrative inverted-F antenna configuration of the type that may be used to implement a tunable antenna. As shown in FIG. 5, antenna 40 may be provided with an inductor L that couples a portion of antenna resonating element arm 108 (e.g., a tip of arm 108) in resonating element 106 to antenna ground 104. Inductor L may be a fixed inductor or may be a variable inductor. For example, inductor L may be an adjustable inductor that is formed from one or more switches or other switching circuitry and a set of fixed inductors. During operation of device 10, control circuitry 28 can issue control signals that adjust the switching circuitry (e.g., that open and close switches in the switching circuitry), thereby switching desired patterns of the set of fixed inductors into and out of use to adjust the inductance value of inductor L. Adjustments such as these may be made to vary the inductance of inductor L when it is desired to tune the frequency response of antenna 40 (e.g., when it is desired to tune the low band resonance of antenna 40, when it is desired to tune a mid-band resonance of antenna 40, etc.). For example, increases to the value of L may be made to increase the frequency of the communications band(s) in which antenna 40 is operating (e.g., to increase a low-band resonant frequency or a mid-band resonant frequency). One or more inductors such as inductor L may be coupled between arm 108 and ground 104 at one or more locations along the length of arm 108. The configuration of FIG. 5 is illustrative.

Figure 6:
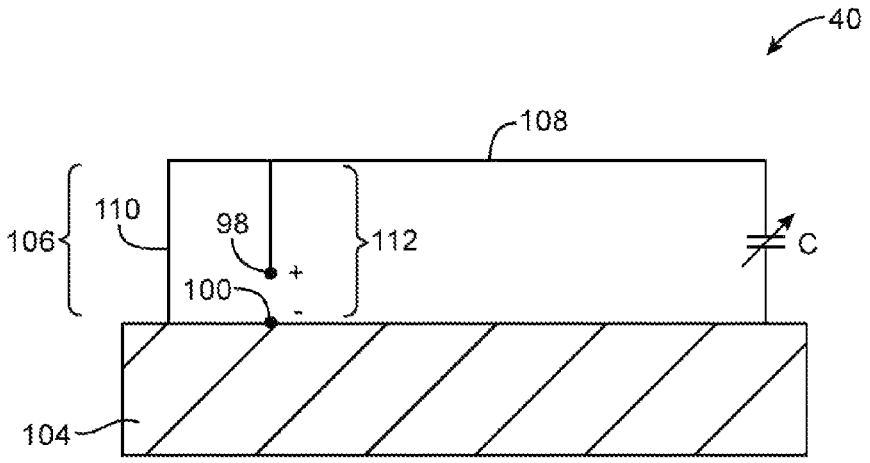
FIG. 6 is a schematic diagram of an illustrative inverted-F antenna with a capacitor to tune the antenna to cover desired operating frequencies in accordance with an embodiment.

FIG. 6 is a diagram of an illustrative inverted-F antenna structure with a capacitor that may be used to implement a tunable antenna. As shown in FIG. 6, antenna 40 may be provided with a capacitor C that couples a tip portion of antenna resonating element arm 108 in resonating element 106 to antenna ground 104. Capacitors such as capacitor C may also be coupled to arm 108 at other locations. Capacitor C may be a fixed capacitor or may be a variable capacitor. For example, capacitor C may be formed from one or more switches or other switching circuitry and a set of fixed capacitors (e.g., a programmable capacitor) or a varactor. During operation of device 10, control circuitry 28 can issue control signals that open and close switches in the switching circuitry to switch desired capacitors into and out of use or that otherwise make adjustments to capacitor C, thereby varying the capacitance value exhibited by capacitor C. Adjustments such as these may be made to vary the capacitance of capacitance C when it is desired to tune the frequency response of antenna 40 (e.g. when it is desired to tune the low band resonance of antenna 40, when it is desired to tune a mid-band resonance of antenna 40, or when it is desired to tune a high band resonance of antenna 40). For example, increases to the value of C may be made to decrease the frequency range of the communications band(s) in which antenna 40 is operating (e.g., to decrease a high-band resonant frequency). Capacitor C need not be located at the tip of arm 108. For example, the resonant frequency decrease associated with inclusion of capacitor C in antenna 40 can be enhanced by locating capacitor C closer to feed 112.

Figure 7:
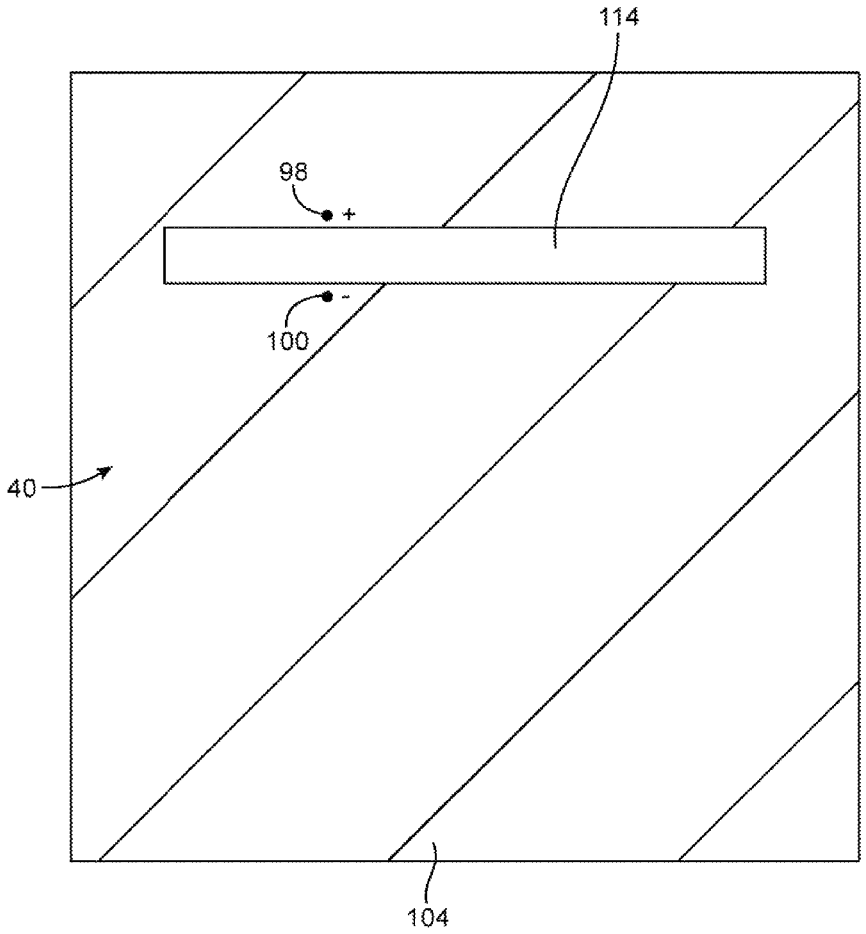
FIG. 7 is a diagram of an illustrative slot antenna in accordance with an embodiment of the present invention.

Antenna 40 may include a slot antenna resonating element. As shown in FIG. 7, for example, antenna 40 may be a slot antenna having an opening such as slot 114 that is formed within antenna ground 104. Slot 114 may be filled with air, plastic, and/or other dielectric. The shape of slot 14 may be straight or may have one or more bends (i.e., slot 114 may have an elongated shape follow a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 7 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e. the tunable components may bridge the slot). If desired, tunable components may have terminals that are coupled to respective locations along the length of one of the sides of slot 114. Combinations of these arrangements may also be used.

If desired, antenna 40 may incorporate conductive device structures such as portions of housing 12. As an example, peripheral conductive structures 16 may include multiple segments such as segments 16-1, 16-2, and 16-3 of FIG. 8 that are separated from each other by gaps 18 (e.g., spaces between the adjoining ends of the segments that are filled with plastic or other dielectric). In antenna 40 of FIG. 8, segment 16-1 may be formed from a strip of stainless steel or other metal that forms a segment of a peripheral conductive housing member (e.g., a stainless steel member or other peripheral metal housing structure) that runs around the entire periphery of device 10. Segment 16-1 may form an antenna resonating arm 108 in an inverted-F antenna. For example, segment 16-1 may form a dual-band inverted-F antenna resonating element having a longer branch that contributes an antenna response in a low frequency communications band (low band LB) and having a shorter branch that contributes an antenna response in a middle frequency communications band (middle band MB). Dual-band inverted-F antenna structures of this type may sometimes be referred to as T-shaped antennas or T-antennas. A return path conductor such as a strip of metal may be used to form return path 110 between peripheral conductive segment 16-1 (i.e., the main resonating element arm of the T-antenna resonating element) and antenna ground 104.

Antenna ground 104 may have ground structures such as a substantially rectangular antenna ground plane portion in the center of device 10 (e.g. the portion of device underlying active area AA of display 14 of FIG. 1). Antenna ground 104 may also have a portion such as ground plane extension 104E that extends outwards from the main antenna ground region in device 10. Ground plane extension 104E may protrude into an end region of device 10 such as lower end region 20. Ground plane extension 104E of antenna ground 104 may be separated from the main portion of antenna ground 104 and peripheral segment 16-1 by an opening that forms antenna slot 114. Antenna slot 114 may be fed using antenna feed 112 (i.e., using antenna feed terminals on opposing sides of slot 114 such as positive antenna feed terminal 98 and ground antenna feed terminal 100). The magnitude of the periphery of antenna slot 108 may determine the frequency at which slot 114 resonances and may therefore be used to produce a desired resonance for antenna 40 (e.g., a high band resonance HB that complements low band resonance LB and midband resonance MB associated with the T-antenna formed from segment 16-1).

When operating antenna 40 in device 10, both the T-antenna formed from segment 16-1 of peripheral conductive housing member 16 (i.e., the inverted-F antenna) and the slot antenna formed from slot 114 may contribute to the overall response of the antenna. Because two different types of antenna contribute to the operation of antenna 40 (i.e., the inverted-F antenna portion and the slot antenna portion), antenna 40 may sometimes be referred to as a hybrid inverted-F slot antenna or hybrid antenna. If desired, optional electrical components such as inductors and/or capacitors may be coupled to antenna 40. For example, one or more inductors such as inductors L1, L2, and L3 may bridge slot 114 or may be coupled to different locations along the periphery of slot 114 and/or one or more capacitors such as capacitors C1 and C2 may bridge slot 114 or may be coupled to different locations along the periphery of slot 114. These optional electrical components may be fixed and/or adjustable components. For example, the values of L1, L2, L3, C1, and/or C2 or a subset of one or more of these components may be adjusted to tune antenna 40.

Figure 8:
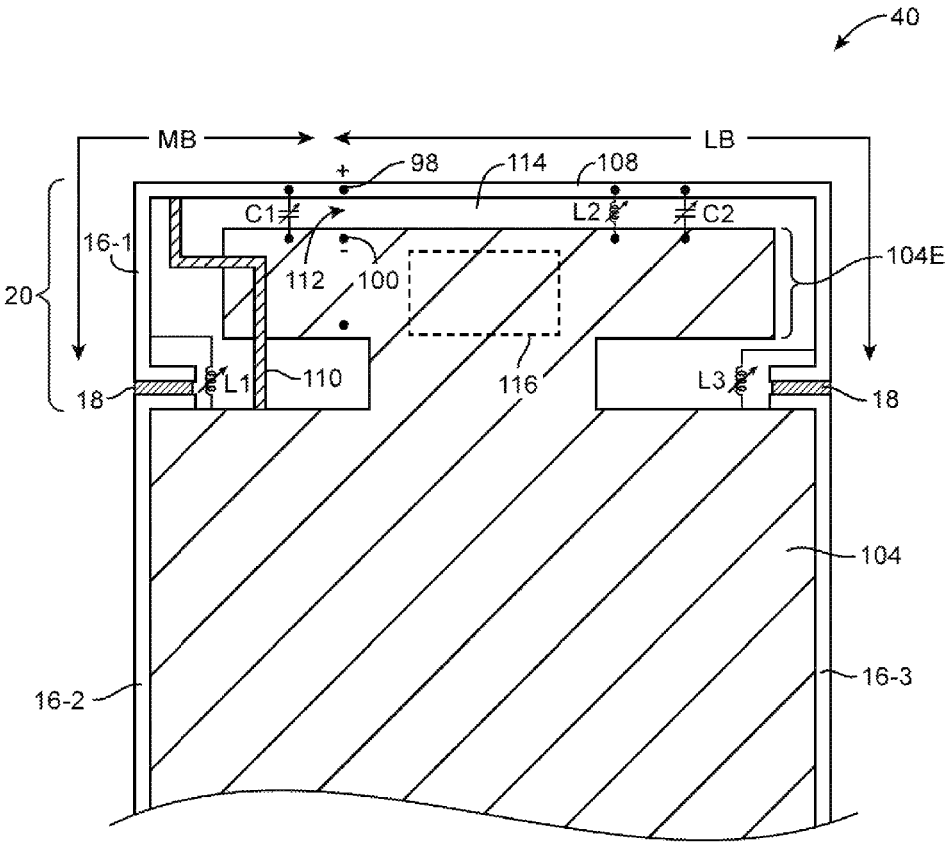
FIG. 8 is a diagram of an illustrative hybrid inverted-F slot antenna having optional tuning components in accordance with an embodiment.
Figure 9:
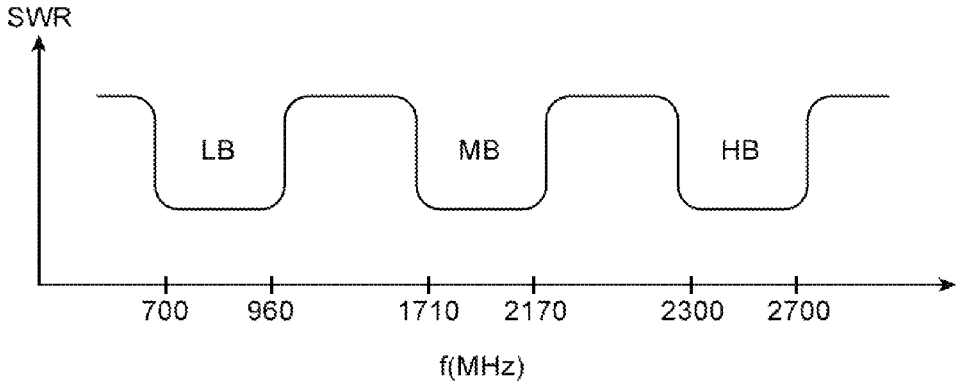
FIG. 9 is a graph in which antenna performance (standing wave ratio) has been plotted as a function of operating frequency for an illustrative antenna of the type shown in FIG. 8 in accordance with an embodiment.

FIG. 9 is a graph in which antenna performance (standing-wave ratio SWR) has been plotted as a function of operating frequency for an illustrative antenna such as antenna 40 of FIG. 8. As shown in FIG. 9, antenna 40 may exhibit multiple resonances to support operation in multiple communications bands. For example, antenna 40 may exhibit three resonances for operating in a low band LB, a middle band MB, and a high band HB. Low band LB may cover communications frequencies from 700 to 960 MHz or other suitable low band frequencies. Middle band MB may cover communications frequencies from 1710 to 2170 MHz or other suitable midband frequencies. High band HB may cover communications frequencies from 2300 to 2700 MHz or other suitable high band frequencies.

The size and shape of conductive antenna structures such as inverted-F antenna resonating element 108, slot antenna resonating element 114 and ground 104 affect the frequency response of antenna 40.

With one suitable arrangement, the antenna resonance of FIG. 9 that is associated with low band LB is produced by the inverted-F antenna structures of antenna 40 of FIG. 8 (i.e., LB is generated by the longer of the two branches of inverted-F resonating element arm 108), the antenna resonance that is associated with middle hand MB may be produced partly by the shorter branch of inverted-F arm 108 and partly by slot 114 (or just by the shorter branch), and the antenna resonance that is associated with high band HB may be produced partly by slot antenna 114 and partly by a harmonic of low band LB (e.g. a second harmonic that is tuned to lower frequencies using one or more capacitors such as capacitors C1 and/or C2). Tunable inductor L2 may be used to tune low band LB. Tunable inductor L may be used to tune midband MB. Optional inductor L3 may have a fixed value that helps ensure that the low band resonance LB covers desired low band frequencies.

The total inductance bridging slot 114 in the vicinity of inductor L1 and return path 110 is affected by both the inductance of inductor L1 and the inductance of return path 110, which bridges slot 114 in parallel with inductor L1. The inductance of return path 110 may be about 6 nH (as an example). Tunable inductor L1 may, as an example, have an inductance value that is adjustable between a first state of 0 nH and a second state of 12 nH (as an example). With this type of arrangement, inductor L1 operating in parallel with return path 110 may be used to generate a first inductance of 0 nH (when inductor L1 exhibits a 0 nH inductance) or 6 nH (when inductor L1 is 12 nH and the parallel inductance of return path 110 is 12 nH).

There may be one capacitor bridging slot 114, two capacitors bridging slot 114, or three or more capacitors bridging slot 114. The capacitors can be located at the position shown by capacitors C1 and C2 of FIG. 8 or other locations in antenna 40. In the presence of one or more optional capacitors such as capacitors C1 and C2 of FIG. 8, the frequency response of antenna 40 can be pulled lower as described in connection with FIG. 6.

Device 10 may include connectors for data ports and other electrical components. One or more of these electrical components may be mounted in housing 12 in a position that minimizes interference with antenna 40. For example, a data port connector or other electrical component may be mounted in device 10 in a location such as location 116 that overlaps ground plane extension 104E.

With another suitable arrangement for antenna 40 of FIG. 8, inductor L1 may be omitted. Inductor L3 may be a fixed or variable inductor that helps configure antenna 40 so that low band resonance LB covers desired operating frequencies. Low band LB may be covered using the long branch of antenna resonating element 108 and may be tuned by adjusting the inductance value produced by adjustable inductor L2. Middle band MB may be covered using the short branch of antenna resonating element 108. Antenna slot 114 may be used to create antenna resonance HB (and, if desired, a second harmonic of the low band resonance from element 108 may contribute to resonance HB).

In the illustrative configuration of FIG. 8, antenna 40 has a single port (i.e., antenna feed 112 is the sole antenna feed for antenna 40). Antenna feed 112 is formed from antenna feed terminals 98 and 100 that extend between resonating element arm 108 and ground 104, bridging slot 114. Antenna feed terminals 98 simultaneously serve as a feed for the inverted-F antenna portion of hybrid antenna 40 and as a feed for the slot antenna portion of hybrid antenna 40. During operation at frequencies in which the inverted-F antenna resonating element portion of antenna 40 is active, the antenna feed formed from terminals 98 and 100 feeds the inverted-F antenna resonating element portion of antenna 40. During operation at frequencies in which the slot antenna resonating element portion of antenna 40 is active, the antenna feed formed from terminals 98 and 100 feeds the slot antenna resonating element portion of antenna 40. The antenna feed is used to feed both the inverted-F antenna portion and the slot antenna portion of antenna 40 at frequencies in which both the inverted-F structures and slot structures contribute to antenna performance.

Antenna structures such as antenna 40 of FIG. 8 may be provided with multiple ports if desired. For example, a first feed may be located at one point along the length of slot 114 and a second feed may be located at a different point along the length of slot 114. In a configuration with multiple feeds, each of the multiple feeds may serve as an inverted-F feed and a slot feed or some of the feeds may be associated primarily or exclusively with the inverted-F antenna and other feeds may be associated primarily or exclusively with the slot antenna.

Figure 10:
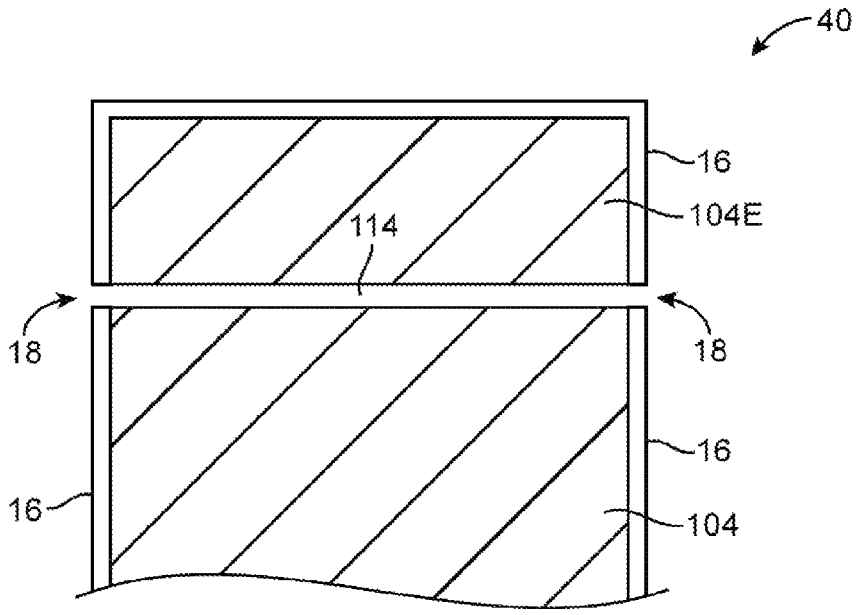
FIG. 10 is a diagram of an illustrative electronic device having a slot that may be used in forming an antenna in accordance with an embodiment.
Figure 11:
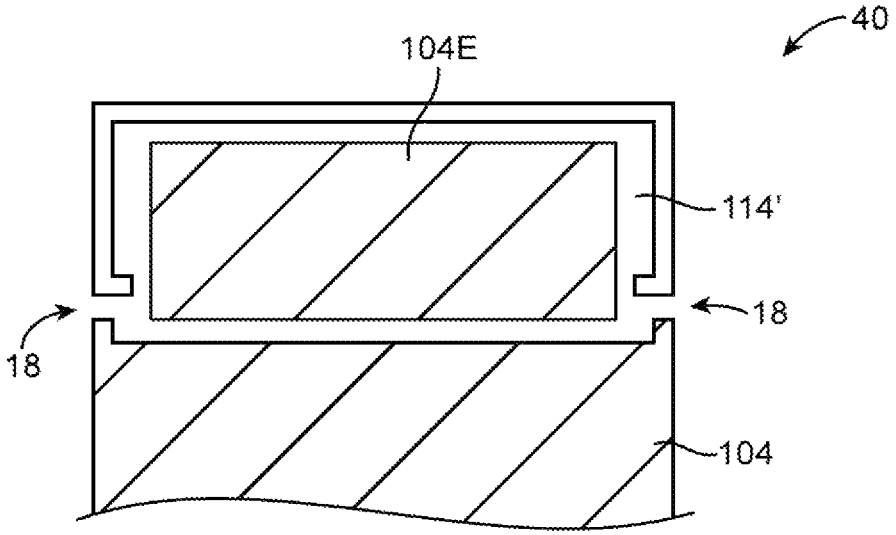
FIG. 11 is a diagram of an illustrative electronic device with a narrow loop-shaped opening that has a portion running between an extended portion of a ground plane and a peripheral conductive housing member in accordance with an embodiment.

If desired, the conductive structures of antenna 40 may be configured to form slot resonating elements and inverted-F antenna resonating elements of different configurations. In the example of FIG. 10, antenna 40 has an antenna resonating element slot 114 that extends across the entire width of device 10. In the example of FIG. 11, a resonating element is formed from a slot-shaped opening such as opening 114' that loops around ground plane extension 104E.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having peripheral conductive structures; and a hybrid inverted-F slot antenna, wherein the hybrid inverted-F slot antenna has an inverted-F antenna portion formed from an inverted-F antenna resonating element and an antenna ground, wherein the inverted-F antenna resonating element is formed from the peripheral conductive structures, wherein the hybrid inverted-F slot antenna has a slot antenna portion formed from an opening between the inverted-F antenna resonating element and the antenna ground, and wherein the hybrid inverted-F slot antenna has an antenna feed that feeds both the inverted-F antenna portion and the slot antenna portion.

2. The electronic device defined in claim 1 further comprising an adjustable component coupled to the peripheral conductive structures.

3. The electronic device defined in claim 2 further comprising control circuitry that controls the adjustable component to tune the hybrid inverted-F slot antenna.

4. The electronic device defined in claim 3 wherein the adjustable component comprises an adjustable inductor that bridges the opening.

5. The electronic device defined in claim 3 wherein the adjustable component comprises an adjustable capacitor that bridges the opening.

6. The electronic device defined in claim 3 wherein the hybrid inverted-F slot antenna is configured to operate in low, medium, and high communications bands and wherein the adjustable component comprises an adjustable inductor that is controlled by the control circuitry to tune the low communications band.

7. The electronic device defined in claim 6 wherein the inverted-F antenna portion is configured to exhibit respective resonances in at least the low and medium communications bands and wherein the slot antenna portion is configured to exhibit a resonance in the high communications band.

8. The electronic device defined in claim 6 further comprising an additional adjustable inductor bridging the opening that is controlled by the control circuitry to tune the middle communications band.

9. The electronic device defined in claim 3 wherein the hybrid inverted-F slot antenna is configured to operate in low, medium, and high communications bands and wherein the adjustable component comprises a capacitor with which the high communications band is pulled to a lower frequency.

10. The electronic device defined in claim 9 wherein the inverted-F antenna portion is configured to exhibit resonances in at least the low and medium communications bands and wherein the slot antenna portion is configured to exhibit a resonance in the high communications band.

11. The electronic device defined in claim 1 further comprising a display with an active area, wherein the antenna ground has a first portion that is overlapped by the active area and a second portion that extends from the first portion and wherein the second portion is separated from the peripheral conductive structure by the opening.

12. The electronic device defined in claim 1 further comprising a tunable inductor coupled to the peripheral conductive structures and a tunable capacitor coupled to the peripheral conductive structures.

13. The electronic device defined in claim 12 further comprising a rectangular housing, wherein the peripheral conductive structures are portions of a metal housing sidewall that runs around the housing and that includes gaps to create a metal segment and wherein the metal segment forms short and long branches of an arm in the inverted-F antenna resonating element.

14. A hybrid inverted-F slot antenna, comprising:

a peripheral conductive member of an electronic device housing;

a ground with an extended portion adjacent to the peripheral conductive member so that the extended portion of the ground and the peripheral conductive member are separated by a slot; and an antenna feed having a positive antenna feed terminal coupled to the peripheral conductive member and a ground antenna feed terminal coupled to the ground plane, wherein the antenna feed feeds an inverted-F antenna portion of the hybrid inverted-F slot antenna formed from the peripheral conductive member and the ground and feeds a slot antenna portion of the hybrid inverted-F slot antenna formed from the slot.

15. The hybrid inverted-F slot antenna defined in claim 14 wherein the electronic device housing comprises a handheld electronic device housing, wherein the peripheral conductive member includes a metal segment of a peripheral housing sidewall structure of the electronic device housing, and wherein the inverted-F antenna portion of the hybrid inverted-F slot antenna comprises a first branch and a second branch of a resonating element arm that is formed from the metal segment.

16. The hybrid inverted-F slot antenna defined in claim 15 wherein the inverted-F antenna portion and the slot antenna portion are configured so that the hybrid inverted-F slot antenna resonates in a low band, a middle band, and a high band.

17. The hybrid inverted-F slot antenna defined in claim 16 further comprising an adjustable component that bridges that slot to tune the low band.

18. A hybrid inverted-F slot antenna comprising:

a peripheral conductive member that runs along at least part of an electronic device housing periphery;

a ground that is separated from the peripheral conductive member by a slot;

an adjustable component coupled to the peripheral conductive member; and an antenna feed having a positive antenna feed terminal coupled to the peripheral conductive member and a ground antenna feed terminal coupled to the ground, wherein the antenna feed feeds an inverted-F antenna structure formed from the peripheral conductive member and the ground and feeds a slot antenna structure formed from the slot.

19. The hybrid inverted-F antenna defined in claim 18 wherein the inverted-F antenna structure is configured to resonate in a first communications band and wherein the adjustable component comprises an adjustable inductor that bridges the slot.

20. The hybrid inverted-F antenna defined in claim 19 wherein the inverted-F antenna structure is configured to resonate in a second communications band and wherein the slot is configured to resonate in a third communications band, wherein the second communications band covers higher frequencies than the first communications band, and wherein the third communications band covers higher frequencies than the second communications band.

* * * * *